US008915492B2

(12) United States Patent
Sugiyama et al.

(10) Patent No.: US 8,915,492 B2
(45) Date of Patent: Dec. 23, 2014

(54) SHEET FINISHING APPARATUS AND SHEET FINISHING METHOD

(75) Inventors: Hideaki Sugiyama, Shizuoka (JP); Katsuhiko Tsuchiya, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 120 days.

(21) Appl. No.: 13/602,050

(22) Filed: Aug. 31, 2012

(65) Prior Publication Data

US 2013/0062825 A1 Mar. 14, 2013

Related U.S. Application Data

(60) Provisional application No. 61/533,161, filed on Sep. 9, 2011, provisional application No. 61/540,485, filed on Sep. 28, 2011.

(51) Int. Cl.

| | |
|---|---|
| ***B65H 31/36*** | (2006.01) |
| ***B65H 31/34*** | (2006.01) |
| ***B42C 1/12*** | (2006.01) |
| ***B65H 31/26*** | (2006.01) |
| ***B65H 37/04*** | (2006.01) |
| ***B65H 39/10*** | (2006.01) |
| *B65H 31/30* | (2006.01) |
| *B42B 4/00* | (2006.01) |

(52) U.S. Cl.

CPC ..... *B65H 31/36* (2013.01); *B65H 31/34* (2013.01); *B42C 1/12* (2013.01); *B65H 31/26* (2013.01); *B65H 31/3054* (2013.01); *B65H 37/04* (2013.01); *B65H 39/10* (2013.01); *B65H 2513/41* (2013.01); *B65H 2513/51* (2013.01); *B65H 2701/1313* (2013.01); *B65H 2801/27* (2013.01); *B42B 4/00* (2013.01); *B42C 1/125* (2013.01)

USPC ..... 270/58.12; 270/58.17; 270/58.27; 271/220; 271/221

(58) Field of Classification Search

CPC ..... B42C 1/12; B65H 31/26; B65H 31/34; B65H 37/04; B65H 2801/27; B65H 2301/4223

USPC ..... 270/58.07, 58.08, 58.11, 58.12, 58.17, 270/58.27; 271/220, 221

See application file for complete search history.

(56) References Cited

U.S. PATENT DOCUMENTS 6,142,461 A * 11/2000 Asao et al. ..... 270/58.09
6,517,067 B2 * 2/2003 Cruz ..... 271/207

(Continued)

FOREIGN PATENT DOCUMENTS

JP 2593508 Y2 2/1999

*Primary Examiner* — Leslie A Nicholson, III
(74) *Attorney, Agent, or Firm* — Patterson & Sheridan LLP

(57) ABSTRACT

According to one embodiment, a sheet finishing apparatus includes a finishing section configured to apply finishing to a sheet placed on a processing tray, a sheet discharging section configured to discharge the sheet subjected to the finishing to a stack tray via a discharge port, a roller attached to a shaft provided in parallel to the discharge port and which rotate in a first direction for guiding the sheet in the direction of the finishing section and a second direction for discharging the sheet, and an arm attached to the shaft to extend in the centrifuging direction from the shaft, rotate with the torque of the shaft, and idly rotate when force for regulating the torque acts. The arm flaps down the trailing end of the sheet on the stack tray onto the stack tray.

4 Claims, 13 Drawing Sheets

(56) References Cited

U.S. PATENT DOCUMENTS

| | | | | |
|---|---|---|---|---|
| 7,055,818 | B2 * | 6/2006 | Furusawa | 271/220 |
| 7,226,050 | B2 * | 6/2007 | Sekiyama et al. | 271/213 |
| 7,500,667 | B2 * | 3/2009 | Miyazaki et al. | 271/189 |
| 7,624,976 | B2 * | 12/2009 | Koie | 270/58.12 |
| 7,717,422 | B2 * | 5/2010 | Matsumoto et al. | 271/270 |
| 7,744,076 | B2 * | 6/2010 | Suzuki et al. | 270/58.11 |
| 8,087,666 | B2 * | 1/2012 | Honda et al. | 271/220 |
| 8,136,812 | B2 * | 3/2012 | Yamashita | 271/265.01 |

* cited by examiner

SHEET FINISHING APPARATUS AND SHEET FINISHING METHOD

CROSS-REFERENCE TO RELATED APPLICATION

This application is based upon and claims the priority of U.S. Provisional Application No. 61/533,161, filed on Sep. 9, 2011, and U.S. Provisional Application No. 61/540,485, filed on Sep. 28, 2011, the entire contents of which are incorporated herein by reference.

FIELD

Embodiments described herein relate generally to a sheet finishing apparatus and a sheet finishing method for applying finishing to sheets discharged from an image forming apparatus such as a copying machine, a printer, or a multi-function peripheral (MFP).

BACKGROUND

In an image forming apparatus (e.g., an MFP), a sheet finishing apparatus is provided adjacent to the MFP at a post stage in order to apply finishing to sheets subjected to image formation. The sheet finishing apparatus is called a finisher. The finisher staples or sorts sheets sent from the MFP.

The finisher includes lateral alignment plates that control the position in the width direction of sheets. The finisher aligns the sheets in the width direction and conveys the sheets to a stapler. The stapler staples the sheets. The lateral alignment plates are used as well when the sheets are sorted and discharged.

Sheets discharged from the finisher are discharged from a discharge port to a stack tray. The sheets are sometimes deformed or curled. If the sheets are deformed or curled, the trailing end of the sheet discharged to the stack tray remains in the discharge port, obstructs the discharge of the following sheets, and causes a jam and an alignment failure.

If the leading end of the sheet discharged to the stack tray is curled in a downward direction, the sheets hit the stack tray or the leading end of the sheet is rounded to cause a jam and an alignment failure.

DETAILED DESCRIPTION

Figure 1:
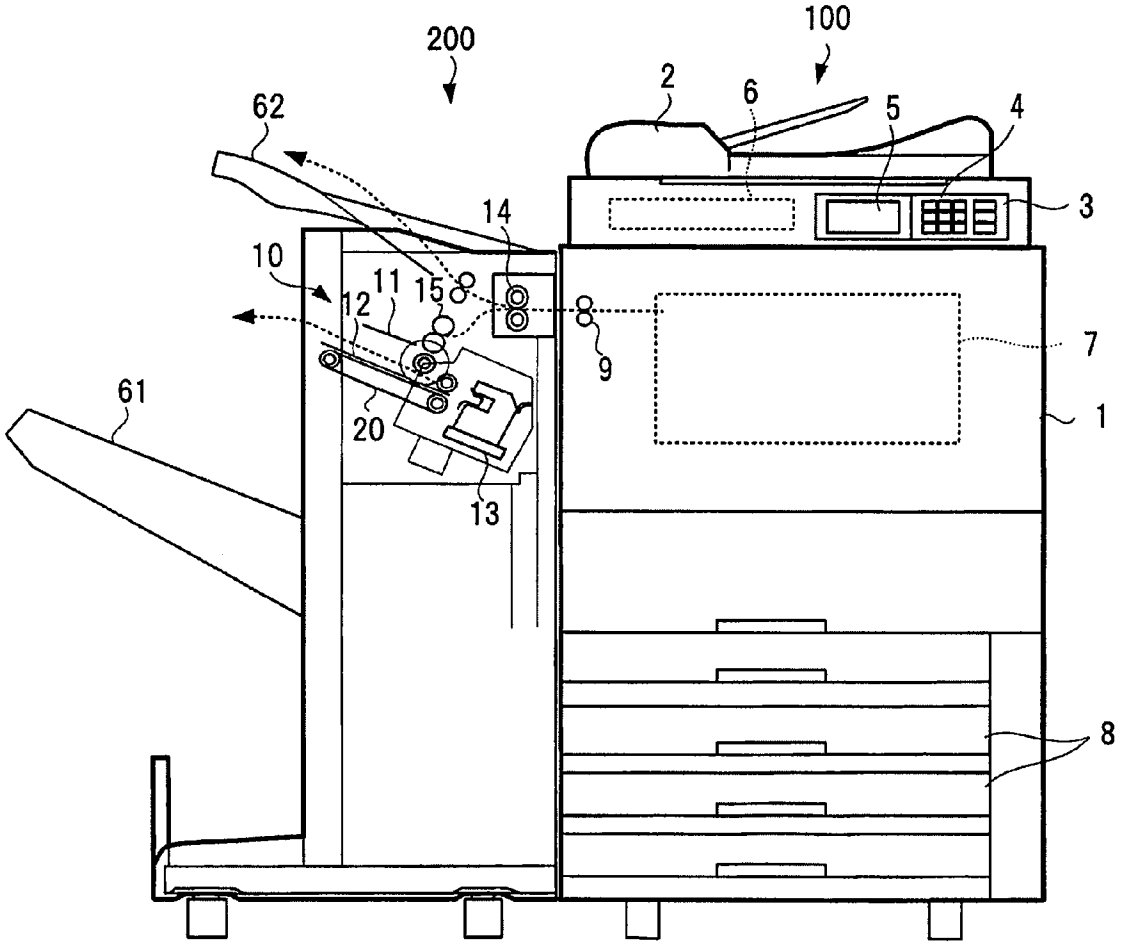
FIG. 1 is a configuration diagram showing an image forming apparatus including a sheet finishing apparatus according to an embodiment.

In general, according to one embodiment, there is provided a sheet finishing apparatus including: a processing tray on which a sheet conveyed from an image forming apparatus is placed;

a finishing section configured to apply finishing to the sheet on the processing tray;

a sheet discharging section configured to discharge the sheet subjected to the finishing to a stack tray via a discharge port;

a roller attached to a shaft provided in parallel to the discharge port and rotate in a first direction for guiding the sheet in a direction of the finishing section and a second direction for discharging the sheet; and an arm attached to the shaft to extend in a centrifuging direction from the shaft, rotate with torque of the shaft, and idly rotate when force for regulating the torque acts;

the arm rotating to a position where the arm hits a regulating member provided on the processing tray side, when the roller rotates in the first direction, and rotating to a position where the arm is regulated by the stack tray and flapping down a trailing end of the sheet on the stack tray onto the stack tray, when the roller rotates in the second direction.

A sheet finishing apparatus according to a first embodiment is explained in detail below with reference to the drawings. In the drawings, the same sections are denoted by the same reference numerals and signs.

FIG. 1 is a configuration diagram of an image forming apparatus including the sheet finishing apparatus.

In FIG. 1, reference numeral 100 denotes the image forming apparatus such as an MFP (Multi-Function Peripheral), which is a compound machine, a printer, or a copying machine. A sheet finishing apparatus 200 is arranged adjacent to the image forming apparatus 100. The sheet finishing apparatus 200 is hereinafter referred to as finisher 200.

A sheet on which an image is formed by the image forming apparatus 100 is conveyed from the image forming apparatus 100 to the finisher 200. The finisher 200 performs finishing such as stapling and sorting for sheets supplied from the image forming apparatus 100.

A document table is present in an upper part of a main body 1 of the image forming apparatus 100. An auto document feeder (ADF) 2 is provided to be capable of opening and closing on the document table. An operation panel 3 is provided in an upper part of the main body 1. The operation panel 3 includes an operation section 4 including various keys and a display section 5 of a touch panel type.

The main body 1 includes a scanner section 6 and a printer section 7 on the inside thereof. Plural cassettes 8 in which sheets of various sizes are stored are provided in a lower part of the main body 1. The scanner section 6 reads an original document fed by the ADF 2 or an original document placed on the document table.

The printer section 7 includes a photoconductive drum and a laser. The printer section 7 scans and exposes the surface of the photoconductive drum with a laser beam emitted from the laser and creates an electrostatic latent image on the photoconductive drum. A charging device, a developing device, a transfer device, and the like are arranged around the photoconductive drum. The electrostatic latent image on the photoconductive drum is developed by the developing device. A toner image is formed on the photoconductive drum. The toner image is transferred onto a sheet by the transfer device. The configuration of the printer section 7 is not limited to the example explained above. There are various systems as the configuration of the printer section 7.

Sheets having images formed thereon by the main body 1 are conveyed to the finisher 200 by a discharge roller 9. In an example shown in FIG. 1, the finisher 200 includes a staple unit 10 that applies stapling to a sheet bundle. The sheets subjected to the finishing by the finisher 200 are discharged to a stack tray 61 or a fixed tray 62. The stack tray 61 can move up and move down.

Figure 2:
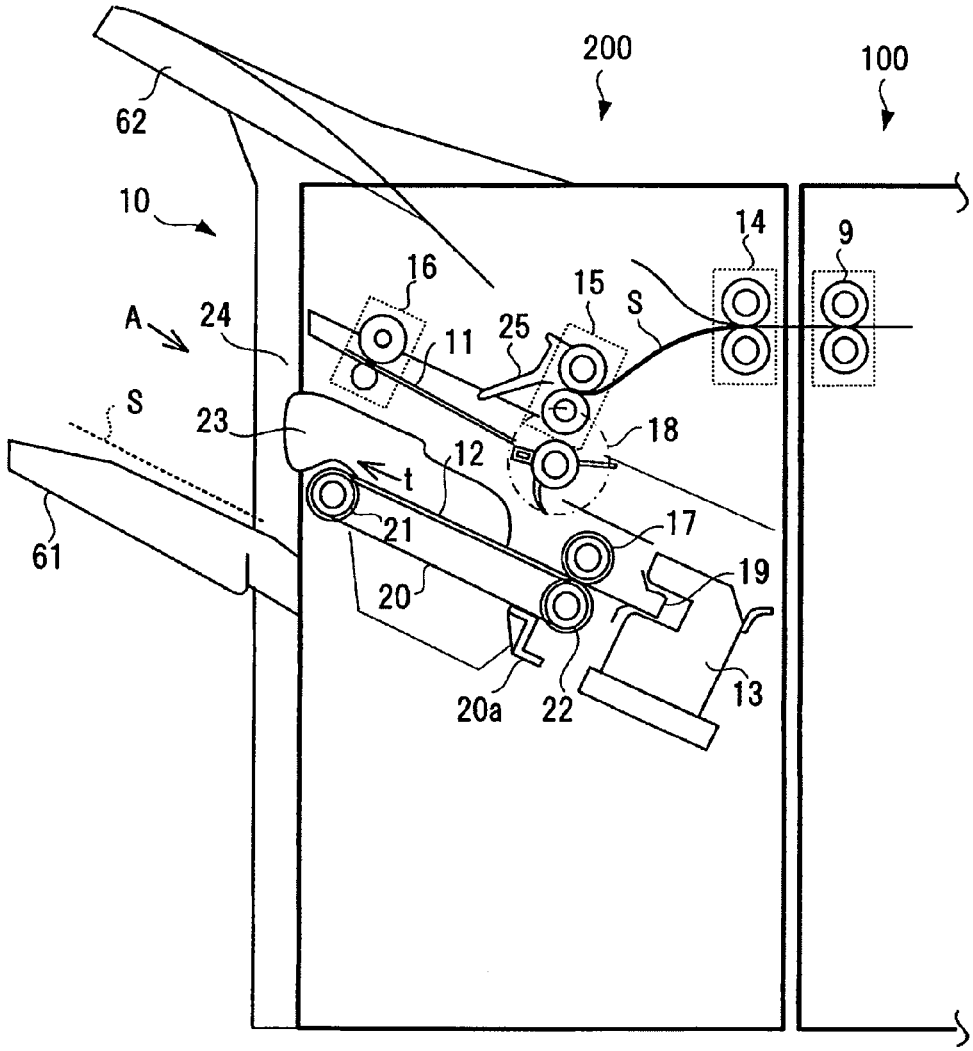
FIG. 2 is a schematic configuration diagram of the sheet finishing apparatus (the finisher) in the embodiment.

FIG. 2 is a schematic configuration diagram of the staple unit 10 of the finisher 200. A sheet S discharged from the discharge roller 9 of the image forming apparatus 100 is conveyed to the staple unit 10.

The staple unit 10 includes a waiting tray 11, a processing tray 12, and a stapler 13. The sheet S from the image forming apparatus 100 is received by an inlet roller 14 provided in a carry-in port of the staple unit 10. The inlet roller 14 includes an upper roller and a lower roller. The inlet roller 14 is driven by a motor.

A paper feeding roller 15 is provided on downstream side of the inlet roller 14. The sheet S received by the inlet roller 14 is sent to the waiting tray 11 via the paper feeding roller 15. The paper feeding roller 15 includes an upper roller and a lower roller. The paper feeding roller 15 is driven by a motor. The processing tray 12 on which the sheet S dropped from the waiting tray 11 is stacked is arranged below the waiting tray 11.

The sheet S is stacked on the waiting tray 11. The waiting tray 11 has an openable structure. When a predetermined number of sheets S are accumulated on the waiting tray 11, the waiting tray 11 opens. The sheets S drop onto the processing tray 12 with the own weight of the sheets S or according to the actuation of a drop supporting member. The processing tray 12 supports the sheets S while the sheets S are stapled by the stapler 13.

The sheets S dropped onto the processing tray 12 are guided to the stapler 13 by a conveying roller 17 and stapled. The conveying roller 17 is driven by a motor. The conveying roller 17 rotates in opposite directions when the sheets S are guided in the direction of the stapler 13 and when the stapled sheets S are discharged.

When being stapled, the plural sheets S dropped from the waiting tray 11 onto the processing tray 12 are aligned in the longitudinal direction, which is a sheet conveying direction, aligned in the lateral direction orthogonal to the sheet conveying direction, and stapled. A lateral alignment section 23 is provided to align the sheets S in the lateral direction. The lateral alignment section 23 performs alignment and sorting of the sheets S (details are explained below). The stapler 13 and the lateral alignment section 23 configure a finishing section in the staple unit 10 and perform finishing such as stapling and sorting.

To assist the sheets S dropping onto the processing tray 12, a rotatable paddle 18 is provided in a position where the trailing end of the sheet S drops. The paddle 18 is attached to a rotating shaft. The paddle 18 flaps down the sheets S, which drop from the waiting tray 11, onto the processing tray 12 and sends the sheets S in the direction of the stapler 13.

A stopper 19 that regulates the trailing end position of the sheet S is provided at the end on the stapler 13 side of the processing tray 12. A conveyor belt 20 is provided in order to convey the sorted or stabled sheets S to the stack tray 61. The conveyor belt 20 is suspended between pulleys 21 and 22. A claw member 20*a* that catches and sends the trailing end of the sheet S is attached to the conveyor belt 20. A mechanism for rotating the pulleys 21 and 22 is omitted.

The conveyor belt 20 rotates in an arrow t direction, whereby the sheets S are discharged from a discharge port 24 to the stack tray 61. The stack tray 61 is lifted and lowered by a motor to receive the sheets S. The conveyor belt 20 and the claw member 20*a* configure a sheet discharging section for guiding the stapled sheets S to the discharge port 24.

If the sheets S stacked on the waiting tray 11 are discharged to the stack tray 61 without being stapled, the sheets S can be discharged by a rotating roller 16 as well without being dropped onto the processing tray 12. The sheets S not required to be stapled can be discharged to the fixed tray 62 as well. A conveying path for guiding the sheets S to the fixed tray 62 is provided. An assist arm 25 is swingably attached to an attachment shaft of the upper roller of the paper feeding roller 15. The assist arm 25 projects to a discharge side of the paper feeding roller 15. The assist arm 25 presses the trailing end side of the sheet S, which are discharged from the paper feeing roller 15, against the waiting tray 11 to prevent the trailing end side from rising.

Figure 3:
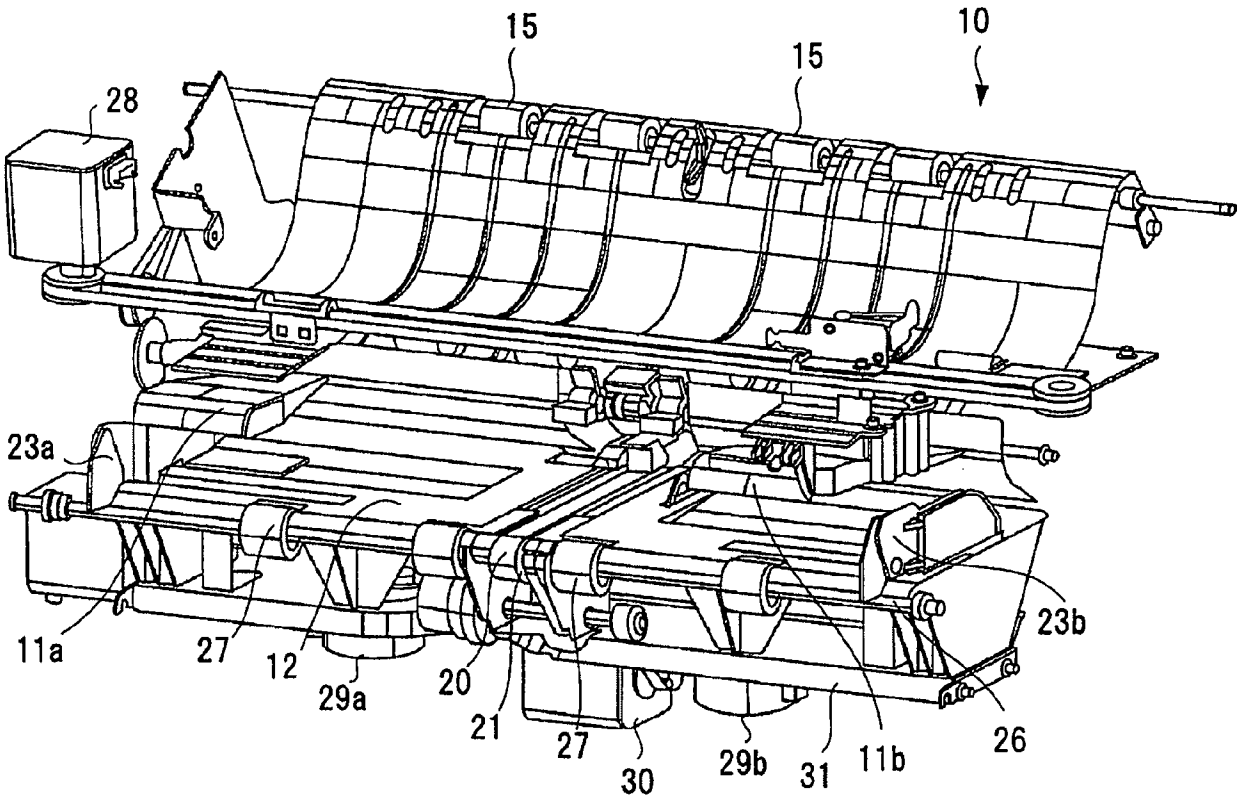
FIG. 3 is a perspective view of the configuration around a processing tray in the embodiment.

FIG. 3 is a perspective view of the staple unit 10 and is a diagram of the staple unit 10 viewed from an arrow A direction in FIG. 2. In FIG. 3, the waiting tray 11, the processing tray 12, and mechanisms around the waiting tray 11 and the processing tray 12 are mainly shown.

In FIG. 3, a shaft 26 is arranged in parallel to the discharge port 24 (FIG. 2). The shaft 26 is orthogonal to the conveying direction of the sheets S. The pulley 21 is attached to the middle of the shaft 26. The conveyor belt 20 is suspended between the pulley 21 and the pulley 22 (FIG. 2). The conveyor belt 20 is rotated by a motor 30. The conveyor belt 20 cyclically rotates and moves between the stapler 13 and the discharge port 24 along a discharge direction of the sheets S. Rollers 27 are attached to the center and both the sides of the shaft 26. When the sheets are aligned in the longitudinal direction and when the sheets S are discharged to the stack tray 61, the rollers 27 rotate in opposite directions each other. The shaft 26 is rotated by the motor 30 functioning as a driving source. Alternatively, the shaft 26 may be rotated by another motor. The rollers 27 are referred to as discharge rollers 27 for convenience of explanation.

The waiting tray 11 includes a pair of tray members 11*a* and 11*b* and supports both the ends in the width direction of the sheets S. The tray members 11*a* and 11*b* can be moved in the width direction of the sheets S by a motor 28. A pair of lateral alignment plates 23*a* and 23*b* are provided on both the sides of the processing tray 12. The pair of lateral alignment plates 23*a* and 23*b* configure the lateral alignment section 23.

The lateral alignment plates 23*a* and 23*b* can slide in the width direction of the sheets S. The lateral alignment plates 23*a* and 23*b* align, in the lateral direction, the sheets S dropped from the tray members 11*a* and 11*b*. The lateral alignment plates 23*a* and 23*b* are formed in an L shape in cross section. The lateral alignment plates 23*a* and 23*b* are moved in a direction parallel to the shaft 26 by motors 29*a* and 29*b*. The motors 29*a* and 29*b* are attached to a frame 31.

Figure 4:
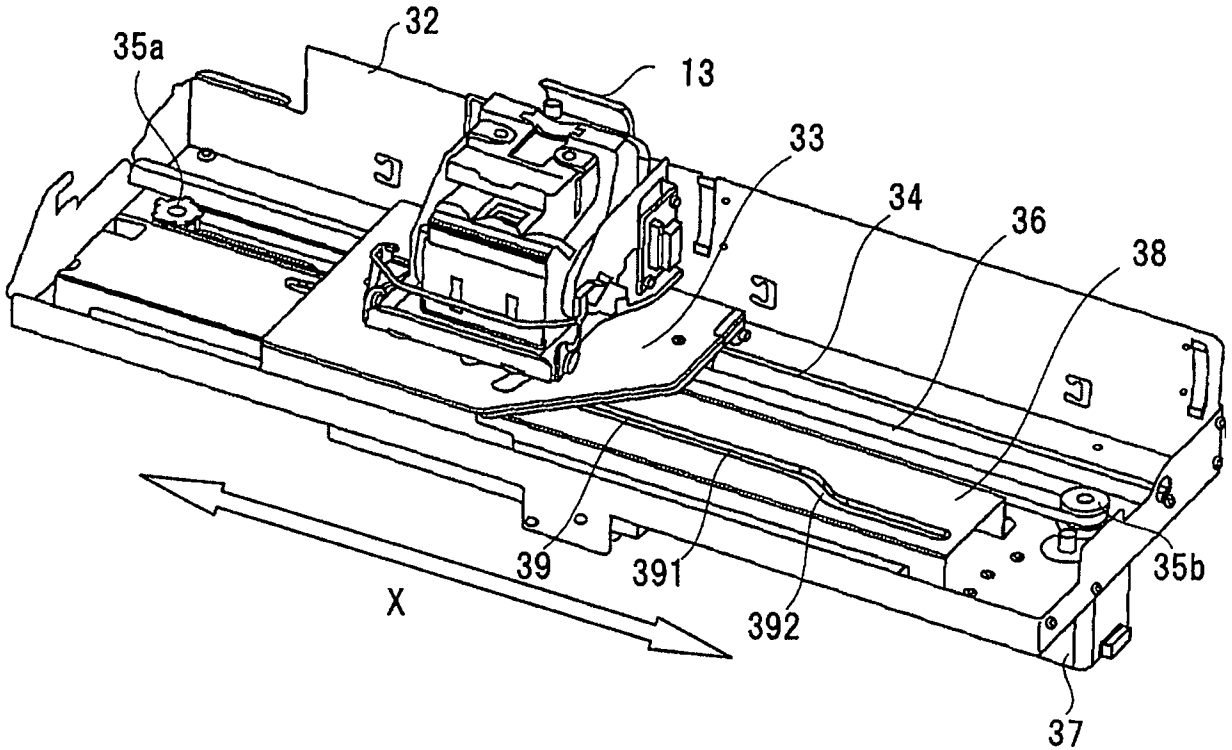
FIG. 4 is a perspective view of the configuration of a stapler in the embodiment.

FIG. 4 is a perspective view of the configuration of the stapler 13. The stapler 13 is attached on a moving plate 33 housed in a frame 32. The moving plate 33 moves along a rail 34. An endless belt 36 is laid over between pulleys 35*a* and 35*b* in order to move the moving plate 33. The endless belt 36 is fixed to the moving plate 33. The pulley 35*b* is normally and reversely rotated by a motor 37, whereby the moving plate 33 moves in an arrow X direction.

A table 38 is provided in parallel to the endless belt 36. A slit 39 is formed on the table 38. The slit 39 includes a linear portion 391 extending in parallel to the rail 34 and an inclined portion 392. The stapler 13 is pivotably attached to the moving plate 33. A pin provided on the bottom of the stapler 13 is inserted into the slit 39.

The trailing end (e.g., two places) can be stapled while the moving plate 33 moves in the linear portion 391 of the slit 39. When the moving plate 33 is moved to the position of the inclined portion 392 of the slit 39 and the pin comes to the position of the inclined portion 392, the stapler 13 pivots about 45 degrees and can staple a corner of the sheets S.

Figure 5:
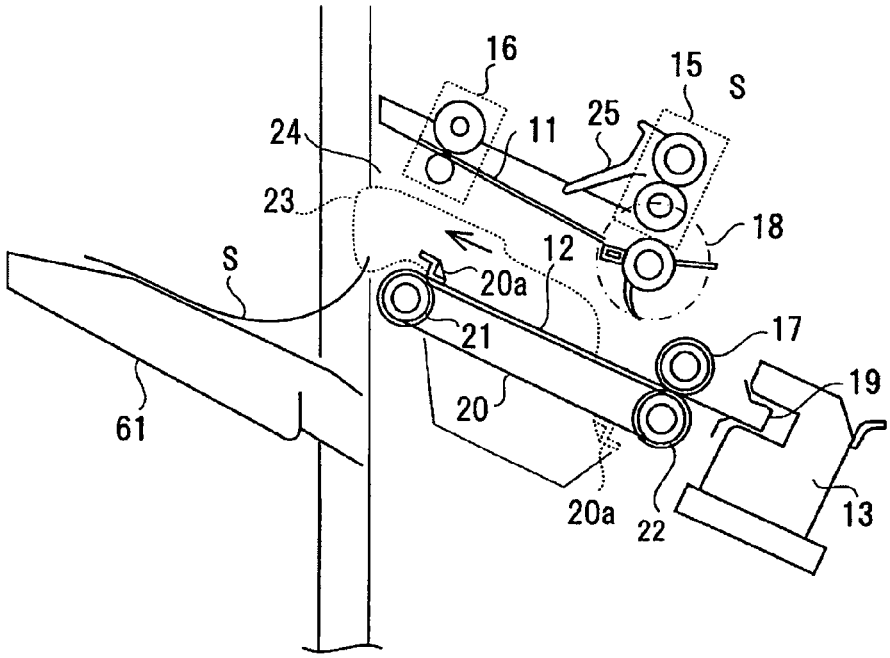
FIG. 5 is an explanatory diagram of deformation of sheets discharged from the finisher.

The sheets S discharged from the staple unit 10 are discharged from the discharge port 24 to the stack tray 61. The sheets S are sometimes deformed or curled. If the sheets S are deformed or curled, for example, as shown in FIG. 5, the trailing end of the sheet S discharged to the stack tray 61 remains at an end of the discharge port 24, obstructs the discharge of the following sheets S, and causes a jam and an alignment failure.

Figure 6:
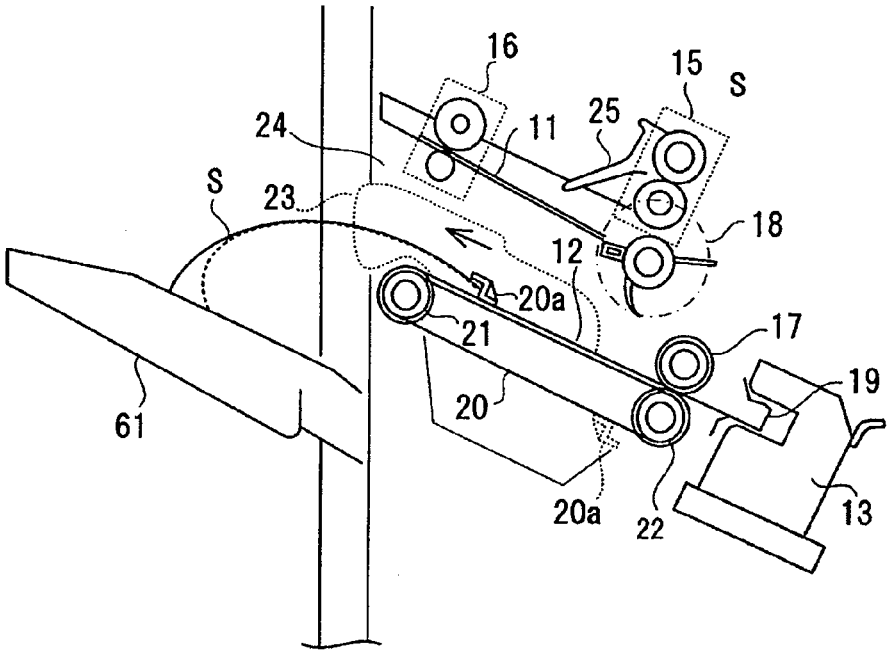
FIG. 6 is an explanatory diagram of curl of sheets discharged from the finisher.

As shown in FIG. 6, if the leading end of the sheet S discharged to the stack tray 61 is curled downward, the sheets S hit the stack tray 61 or the leading end of the sheet S is rounded as indicated by a dotted line to cause a jam and an alignment failure.

Figure 7:
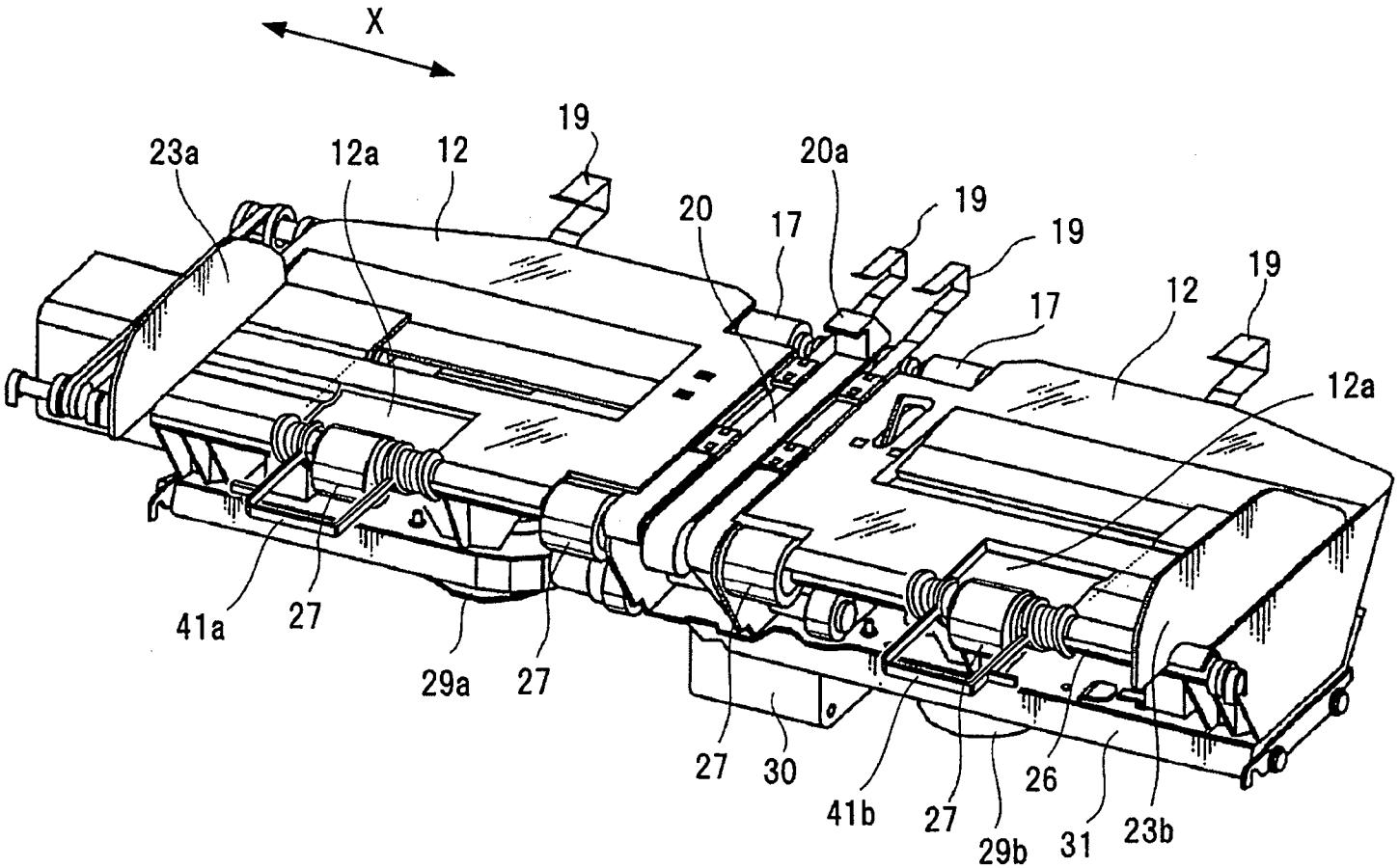
FIG. 7 is a perspective view of the configuration of a main part of the finisher in the embodiment.

FIG. 7 is a perspective view of the configuration of a main part of the finisher according to the first embodiment. In FIG. 7, the trailing end of the sheet S is prevented from remaining at the end of the discharge port 24 as shown in FIG. 5.

In FIG. 7, the configuration of the peripheral section of the processing tray 12, the conveyor belt 20, and the discharge rollers 27 is shown. On both the sides of the processing tray 12, the lateral alignment plates 23*a* and 23*b* are provided to be movable in an arrow X direction. The conveyor belt 20 is provided in the center of the processing tray 12. The motor 30 that drives the conveyor belt 20 and the motors 29*a* and 29*b* that drive the lateral alignment plates 23*a* and 23*b* in the arrow X direction are attached to the frame 31.

The discharge rollers 27 are attached to the center and both the sides of the shaft 26. U-shaped arms 41*a* and 41*b* are attached to the discharge rollers 27 on both the sides. The arms 41*a* and 41*b* are attached to the shaft 26 to hold the discharge rollers 27 from both sides thereof in the axis direction. The arms 41*a* and 41*b* extend in the centrifuging direction of the shaft 26.

The arms 41*a* and 41*b* rotate according to the rotation of the discharge rollers 27. If the discharge rollers 27 rotate clockwise, the arms 41*a* and 41*b* rotate to the processing tray 12 side. If the discharge rollers 27 rotate counterclockwise, the arms 41*a* and 41*b* rotate to the stack tray 61 side. If the arms 41*a* and 41*b* rotate to the processing tray 12 side, the arms 41*a* and 41*b* get into under the processing tray 12 through grooves 12*a* formed in the processing tray 12. The rotation of the arms 41*a* and 41*b* is regulated by the movement of the lateral alignment plates 23*a* and 23*b* (details are explained with reference to FIGS. 10A to 10C).

Figure 8:
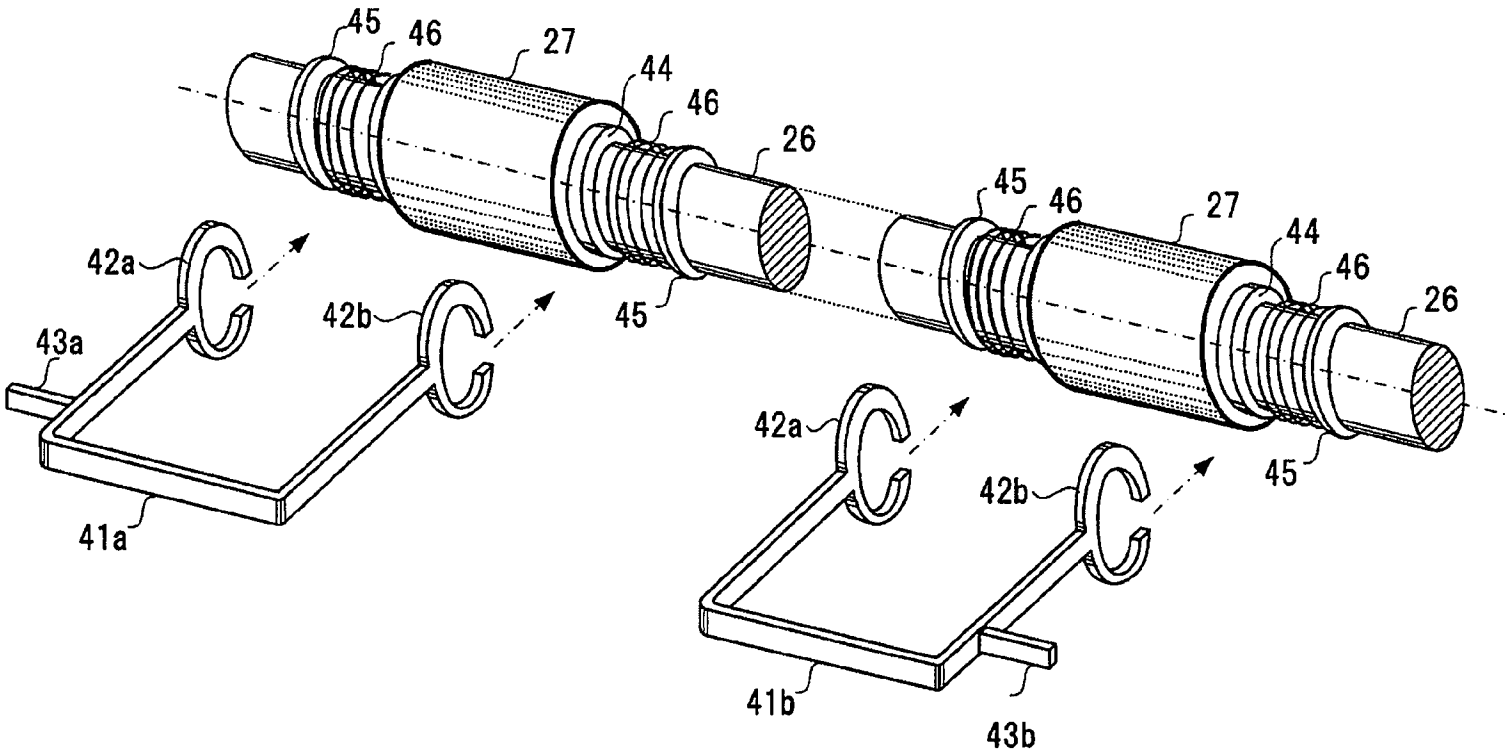
FIG. 8 is an enlarged exploded perspective view of discharge rollers and arms in the embodiment.

FIG. 8 is an enlarged exploded perspective view of the discharge rollers 27 and the arms 41*a* and 41*b*. In FIG. 8, a mechanism for rotating the arms 41*a* and 41*b* with the torque of the shaft 26 and idly rotating the arms 41*a* and 41*b* when force for regulating the torque acts is shown.

The arms 41*a* and 41*b* are formed of, for example, plastic. The arms 41*a* and 41*b* include C-shaped holding sections 42*a* and 42*b* respectively at both the ends on the shaft 26 side. The holding sections 42*a* and 42*b* can be pushed into the outer circumference of the shaft 26. The arms 41*a* and 41*b* include projecting pieces 43*a* and 43*b* projecting to the outward direction.

The discharge rollers 27 are attached to intermediate shafts 44 having a diameter larger than the diameter of the shaft 26. The intermediate shafts 44 project slightly more than both the ends of the discharge rollers 27. The intermediate shafts 44 are integrally formed with the shaft 26. C rings 45 are fixed to the outer circumference of the shaft 26 in positions slightly away from both the ends of the intermediate shafts 44. Springs 46 are attached to the outer circumference of the shaft 26 between both the ends of the intermediate shafts 44 and the C rings 45. The holding sections 42*a* and 42*b* of the arms 41*a* and 41*b* are arranged between the springs 46 and both the ends of the intermediate shafts 44.

Slip torque is applied to the holding sections 42*a* and 42*b* by the springs 46. The holding sections 42*a* and 42*b* are pressed in the directions of the discharge rollers 27 (the directions of both the ends of the intermediate shafts 44). Therefore, when the shaft 26 rotates, the arms 41*a* and 41*b* rotate in the same direction as the shaft 26 with the torque of the shaft 26. Since the discharge rollers 27 also rotate together with the shaft 26, the arms 41*a* and 41*b* rotate according to the rotation of the discharge rollers 27.

If the arms 41*a* and 41*b* rotate clockwise and hit regulating members (stoppers 47 explained below) provided on the processing tray 12 side, the arms 41*a* and 41*b* idly rotate without further rotating. If the arms 41*a* and 41*b* rotate counterclockwise and hit the stack tray 61, the arms 41*a* and 41*b* idly rotate without further rotating. In other words, the arms 41*a* and 41*b* perform actions of rotation and idle rotation with the slip torque (contact pressure determined by the strength of the springs 46).

In general, since the discharge rollers 27 are formed of rubber, if the holding sections 42*a* and 42*b* are set in contact with the discharge rollers 27, the effect of the slip torque is lost. Therefore, the holding sections 42*a* and 42*b* are set in contact with the ends of the intermediate shafts 44.

Figure 9:
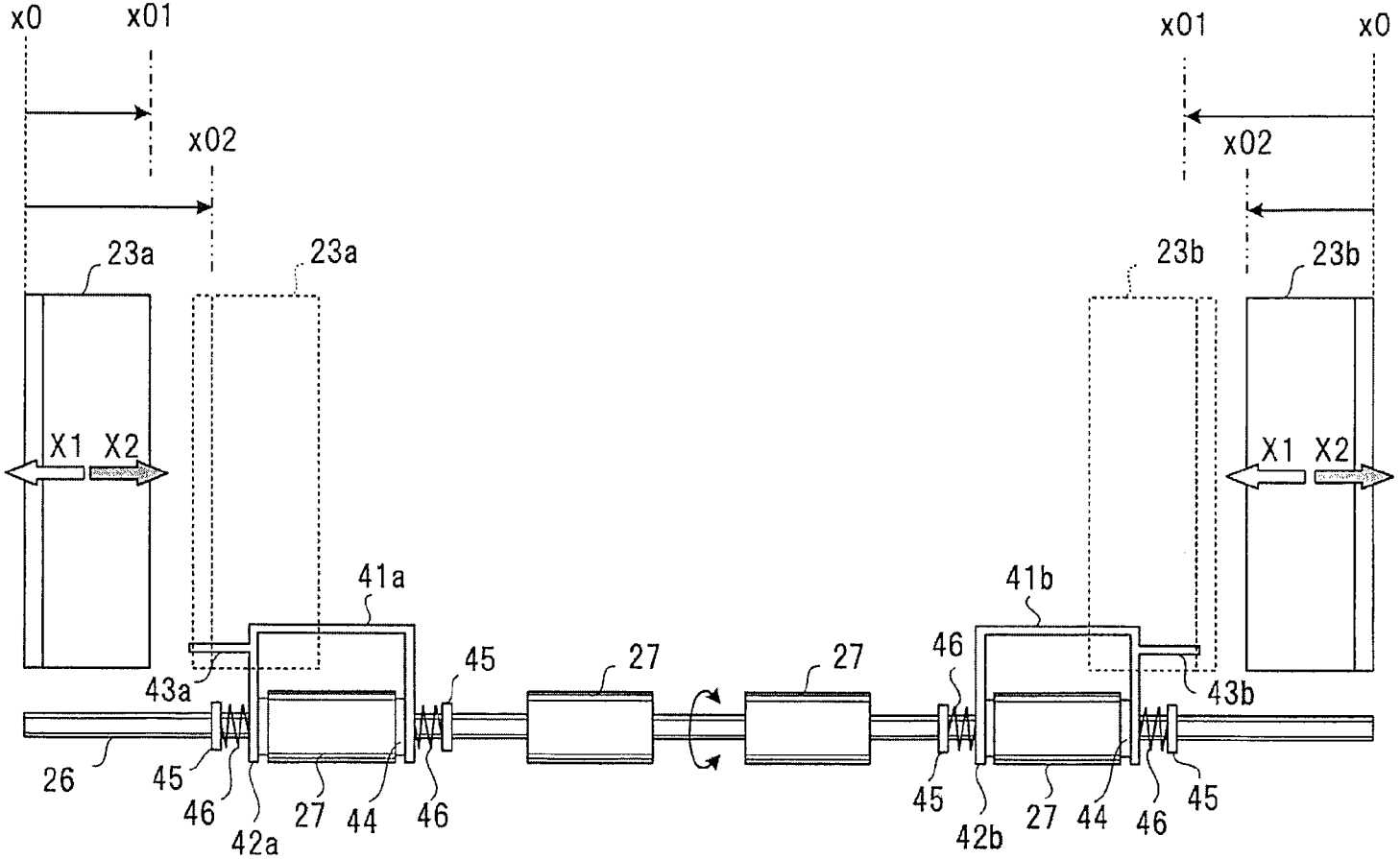
FIG. 9 is a plan view of the discharge rollers, the arms, and lateral alignment plates in the embodiment viewed from above.

FIG. 9 is a plan view of the discharge rollers 27, the arms 41*a* and 41*b*, and the lateral alignment plates 23*a* and 23*b* viewed from above.

In FIG. 9, the lateral alignment plates 23*a* and 23*b* move independently from each other by the motors 29*a* and 29*b* in a direction orthogonal to the conveying direction of the sheets S (an arrow X1 direction or an arrow X2 direction). For example, if the sheets S are stapled, the lateral alignment plates 23*a* and 23*b* move to positions indicated by dotted lines in FIG. 9, hold a bundle of the sheets S from both sides to laterally align the bundle of the sheets S, and guide the bundle of the sheets S to the stapler 13. Immediately before the sheets S are finished being discharged to the stack tray 61, the lateral alignment plates 23*a* and 23*b* open to positions indicated by solid lines.

If the sheets S are sorted and discharged, the lateral alignment plates 23*a* and 23*b* also move. When home positions of the lateral alignment plates 23*a* and 23*b* are represented as x0, during the sorting, the lateral alignment plates 23*a* and 23*b* are alternately moved to a first position (an alternate long and short dash line x01) and a second position (an alternate long and two short dashes line x02) to sort the sheets S. After being sorted, the sheets S are discharged to the stack tray 61.

Figure 10A:
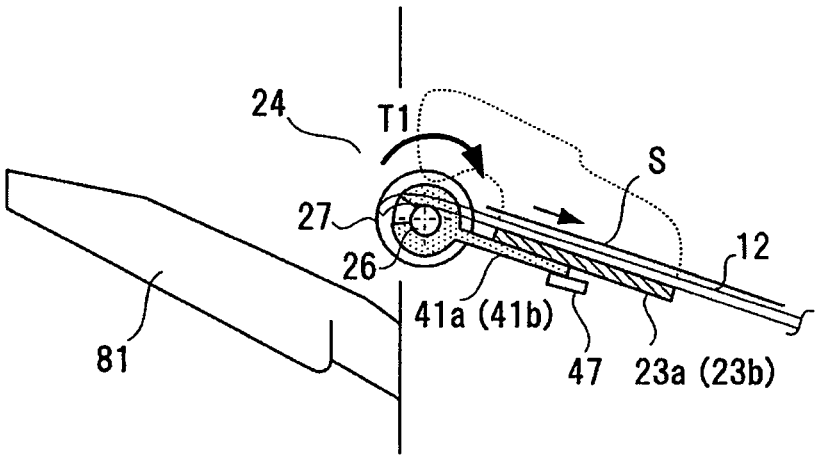
FIGS. 10A to 10C are explanatory diagrams of the operation of the arm in the embodiment.
Figure 10B:
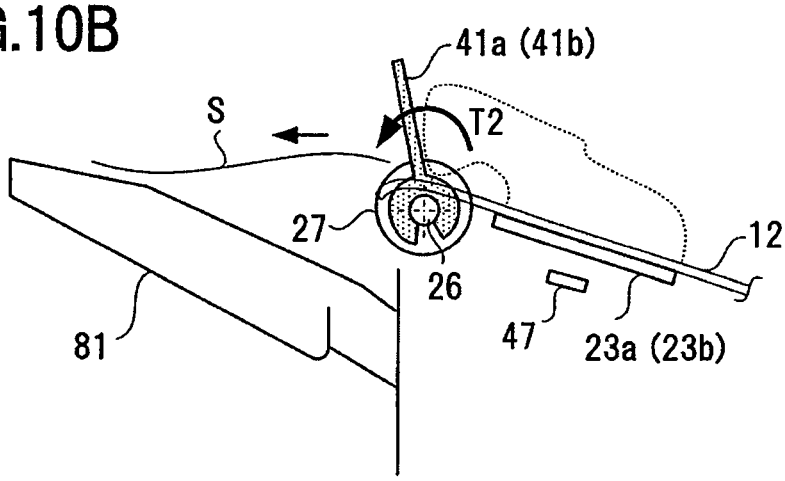
Figure 10C:
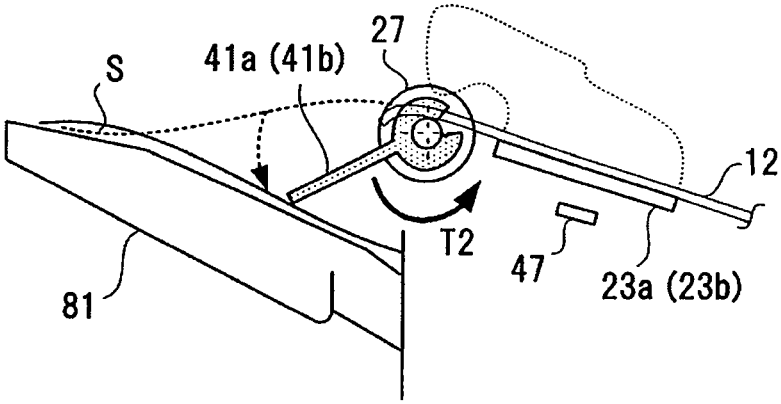

FIGS. 10A to 10C are diagrams for explaining the actions of the arms 41*a* and 41*b*. In the following explanation, stapling is applied to the sheets S as finishing.

As shown in FIG. 10A, when the sheets S are drawn into the stapler 13, the conveying roller 17 and the discharge rollers 27 rotate clockwise (in an arrow T1 direction) and the sheets S are aligned in the longitudinal direction.

According to the rotation of the discharge rollers 27, the arms 41*a* and 41*b* also rotate in the arrow T1 direction to the lower side of the processing tray 12 and hit the stoppers 47. Even if the discharge rollers 27 further rotate in the T1 direction, the arms 41*a* and 41*b* hit the regulating members (the stoppers 47) and idly rotate with the rotation torque regulated. The stoppers 47 are provided on the lower side of the processing tray 12. The stoppers 47 are formed of, for example, members extending downward from the processing tray 12 or formed on the upper surface of the frame 31.

The lateral alignment plates 23*a* and 23*b* move to the positions of the dotted line shown in FIG. 9 and cover the arms 41*a* and 41*b* in order to align the sheets S in the lateral direction. Further, after being aligned in the longitudinal direction and the lateral direction, the sheets S are stapled by the stapler 13.

When the stapling ends and the sheets S are discharged, as shown in FIG. 10B, the discharge rollers 27 rotate counterclockwise (in an arrow T2 direction). The arms 41*a* and 41*b* are also about to rotate counterclockwise. However, the arms 41*a* and 41*b* hit the lateral alignment plates 23*a* and 23*b* and idly rotate with the rotation torque regulated. Immediately before the trailing end of the sheet S is discharged from the discharge port 24, the lateral alignment plates 23*a* and 23*b* open. When the lateral alignment plates 23*a* and 23*b* open and return to the positions of the solid lines shown in FIG. 9, the regulation of the arms 41*a* and 41*b* by the lateral alignment plates 23*a* and 23*b* is released. The arms 41*a* and 41*b* rotate counterclockwise (in the T2 direction).

When the discharge rollers 27 further rotate for a fixed time, as shown in FIG. 10C, the arms 41*a* and 41*b* hit the stack tray 61. Even if the discharge rollers 27 further rotate in the T2 direction, the arms 41*a* and 41*b* hit the stack tray 61 and idly rotate with the rotation torque regulated. Therefore, if the trailing end of the sheet S discharged before remains at the end of the discharge port 24, the trailing end of the sheet S can be flapped down onto the stack tray 61 by the arms 41*a* and 41*b*.

When stapling is executed on the next sheets, the arms 41*a* and 41*b* return to the state shown in FIG. 10A and repeat the same actions. Besides being stapled and discharged, if the sheets S are sorted and discharged, similarly, the sheets S can be flapped down onto the stack tray 61 by the rotation of the arms 41*a* and 41*b*.

As explained above, in the first embodiment, the arms 41*a* and 41*b* held with the slip torque applied thereto are attached on the shaft 26 of the discharge rollers 27. When the sheets S are discharged, the trailing end of the sheet S can be flapped down by rotating the arms 41*a* and 41*b* using the rotation of the shaft 26.

Therefore, even if the sheets S are deformed or curled, possible to accurately discharge the sheets S to the stack tray 61 and reduce occurrence of a jam and an alignment failure. Since the arms 41*a* and 41*b* rotate with the torque of the shaft 26, an extra driving source (motor) is unnecessary and the configuration of the staple unit 10 can be simplified.

The mechanism for rotating the arms 41*a* and 41*b* with the torque of the shaft 26 and idly rotate the arms 41*a* and 41*b* when force for regulating the torque acts is not limited to the configuration shown in FIG. 8. For example, a torque limiter may be attached to the shaft 26 and the arms 41*a* and 41*b* may be attached to the torque limiter. The torque limiter is a safety device that shuts off, when torque equal to or larger than a design value acts, the transmission of the torque. Although costs increase, a highly accurate action can be performed.

A sheet finishing apparatus according to a second embodiment is explained.

Figure 11:
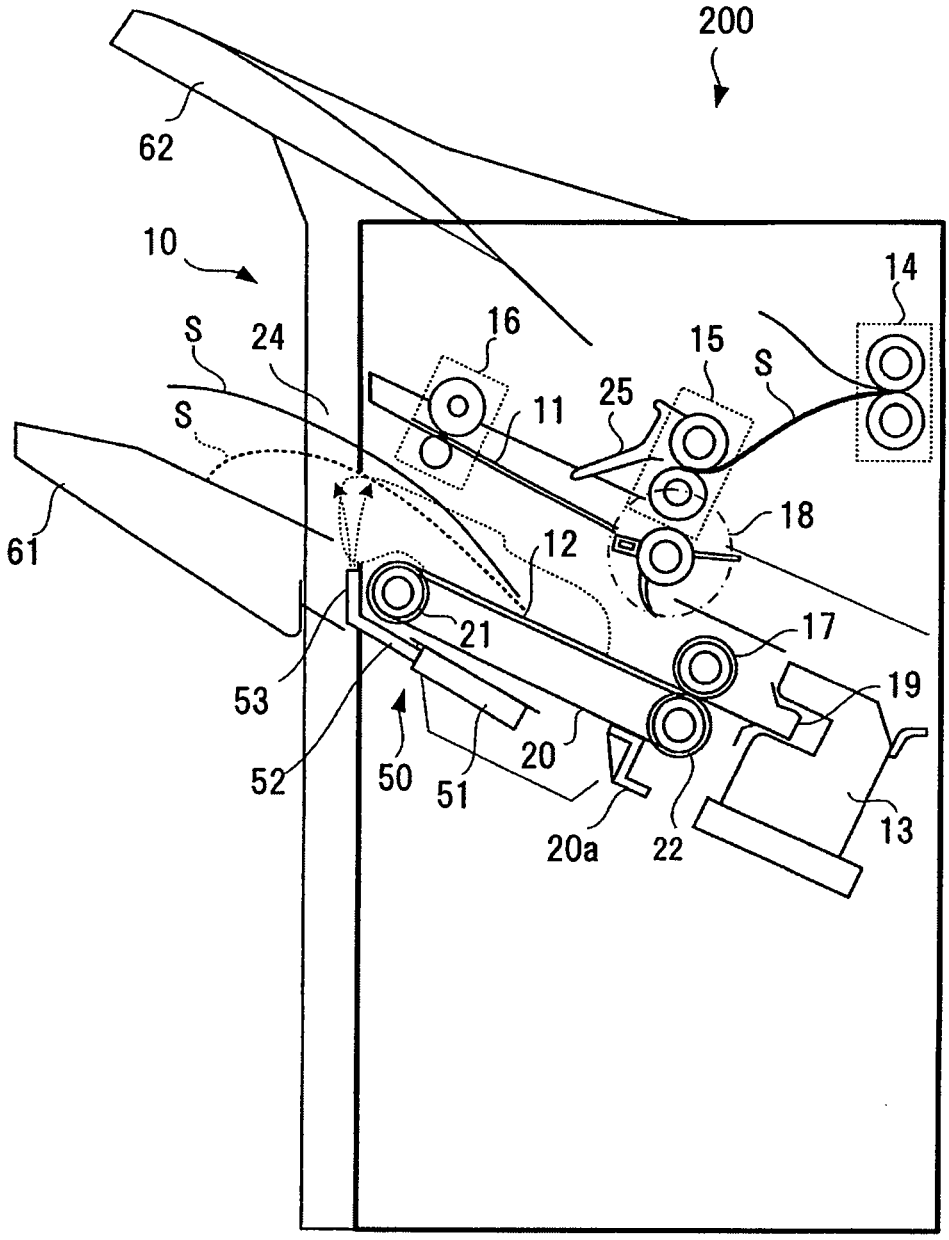
FIG. 11 is a configuration diagram of a finisher according to a second embodiment.

FIG. 11 is a configuration diagram of the configuration of a main part of the finisher according to the second embodiment. In FIG. 11, the leading end of sheet is prevented from hitting the stack tray 61 to be curled as shown in FIG. 6.

In FIG. 11, blower units 50 that blow up the air are provided below the discharge port 24. The blower units 50 are attached to, for example, the bottom of the frame 31. The blower units 50 include air blowers 51 and ducts 52. The air from the air blowers 51 is guided to the lower side of the discharge port 24 through the ducts 52. The air blows out from exhaust ports 53 of the ducts 52.

Figure 12:
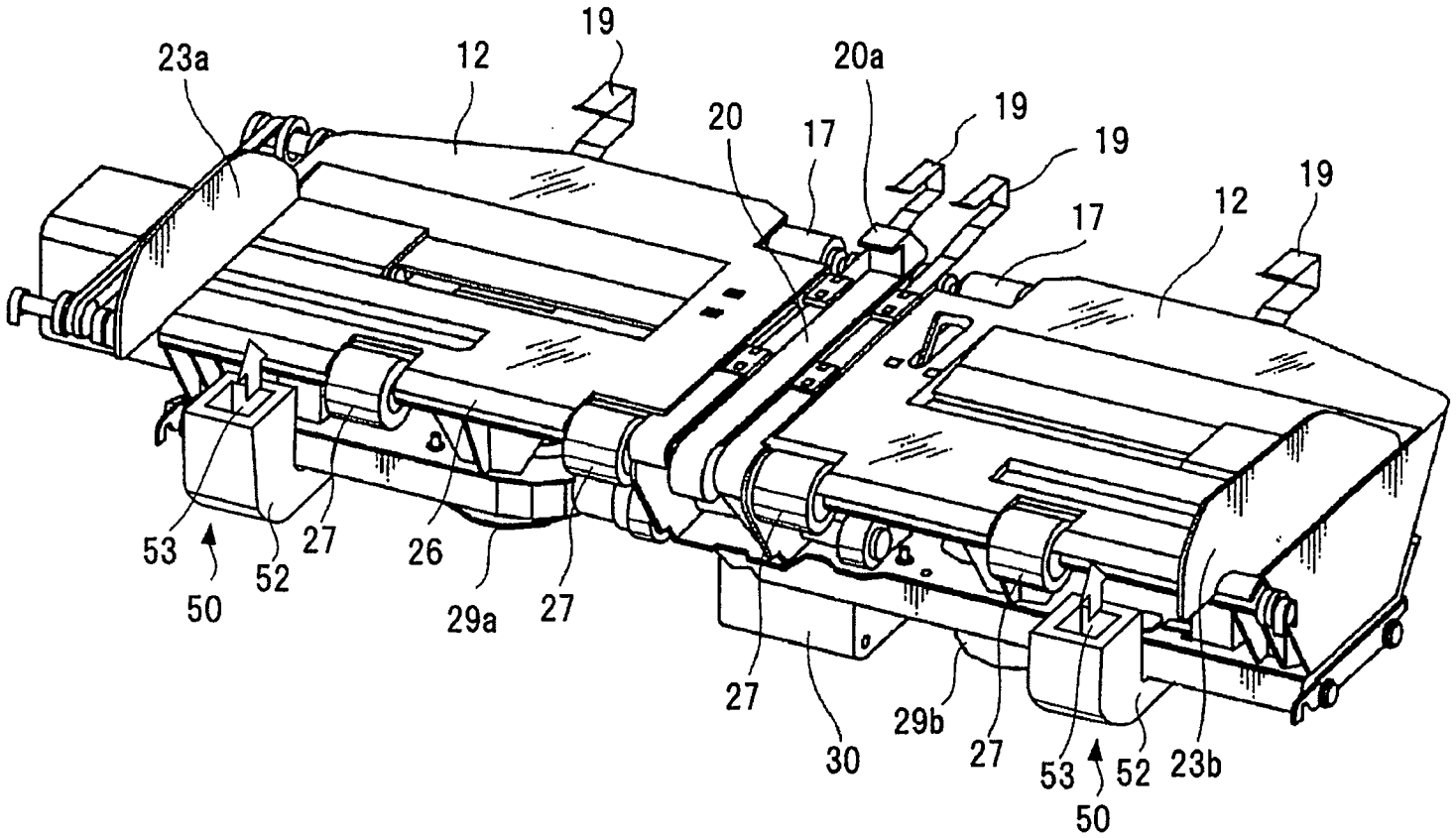
FIG. 12 is a perspective view of the configuration of a main part of the finisher in the second embodiment.

In FIG. 12, the configuration of a peripheral section of the processing tray 12, the conveyor belt 20, and the discharge rollers 27 is shown. In FIG. 12, the exhaust ports 53 of the ducts 52 are provided, for example, in two places in parallel to the discharge port 24. When the sheets S are discharged from the discharge port 24, the sheets S rise in the upward direction with the air blown out from the exhaust ports 53. Therefore, the leading end of the sheet S is placed without hitting the stack tray 61.

In FIG. 11, if the blower units 50 are not provided, the leading end of the sheet S tends to be curled as indicated by a dotted line. However, by blowing the air from the lower side of the sheets S, the sheets S rise as indicated by a solid line. Then, the sheets S are placed on the stack tray 61.

As shown in FIG. 12, since the two blower units 50 are attached to the frame 31, possible to feed the air to both the sides of the sheets S and lift the sheets S in balance. The blower units 50 are not limited to the two places. The blower unit 50 can be added to the center if a space allows.

Figure 13:
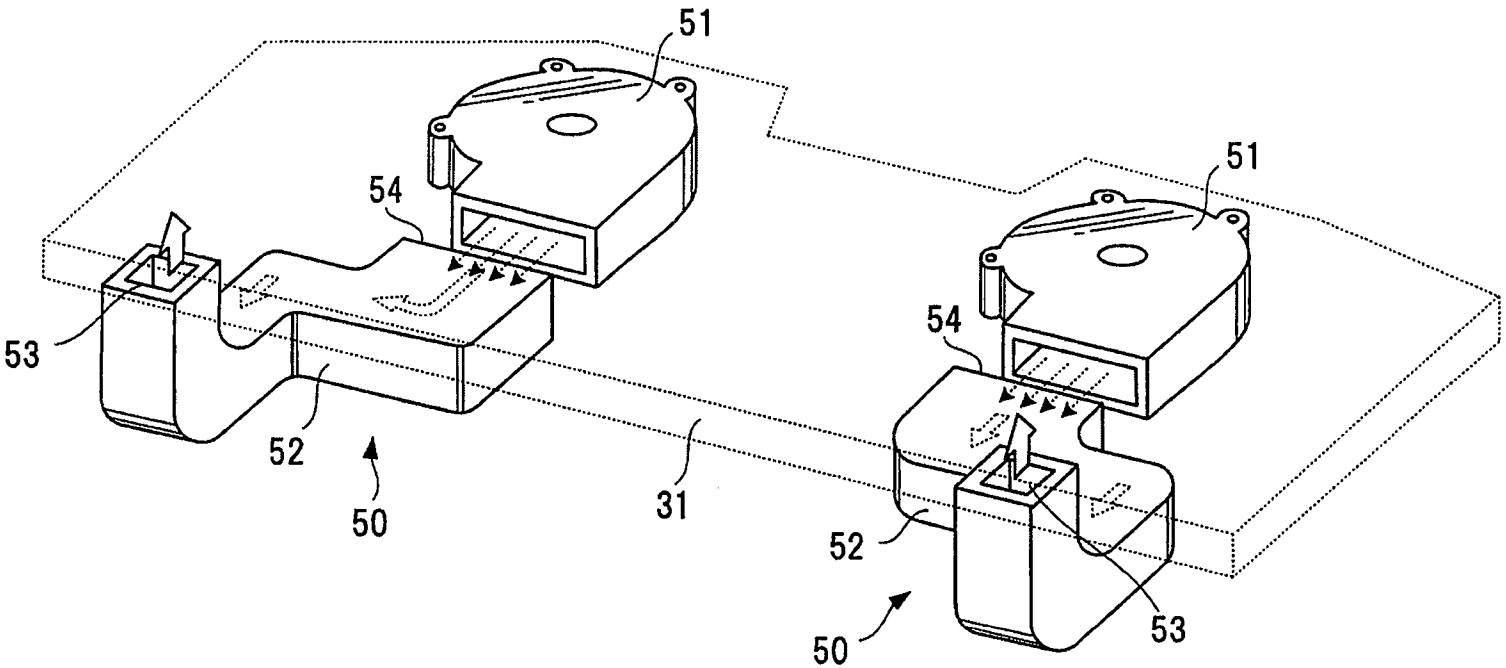
FIG. 13 is an exploded perspective view of blower units in the second embodiment.

FIG. 13 is a perspective view of an example of the blower units 50. The blower units 50 are attached to the bottom surface of the frame 31 to which the mechanisms of the processing tray 12 and the like are attached. The blower units 50 include pairs of the air blowers 51 and the ducts 52. As the air blowers 51, for example, sirocco fans are suitable.

The ducts 52 are curved to guide the air from the air blowers 51 to the lower side of the discharge port 24. The ducts 52 include inlets 54 into which the air blown out from the air blowers 51 is blown and exhaust ports 53, which are blow-out ports for the air. The air from the exhaust ports 53 is blown out from the lower side to the upper side of the discharge port 24.

A structure may be adopted in which one air blower 51 is provided, the duct 52 is divided into two air blowing paths, and the exhaust ports 53 are respectively provided at the ends of the divided air blowing paths. Costs can be reduced by providing only one air blower 51. The blower units 50 may be arranged between the processing tray 12 and the frame 31 if a space allows.

In the second embodiment, one or two sheets can be lifted by the air from the exhaust ports 53. However, if a sheet bundle obtained by stapling a large number of sheets is discharged, the sheet bundle may be unable to be lifted. However, a sheet at the bottom of the sheet bundle can be blown in the upward direction. Therefore, be possible to prevent the sheet at the bottom of the sheet bundle from hanging down to be curled.

According to the second embodiment, possible to prevent the sheets S from being curled and discharged onto the stack tray 61 in a rounded state and reduce occurrence of a jam and an alignment failure. The sheets S conveyed from the image forming apparatus 100 to the finisher 200 are hot. However, possible to cool the sheets S with the air blown out from the blower units 50 and prevent the sheets S from sticking to the stack tray 61.

Figure 14:
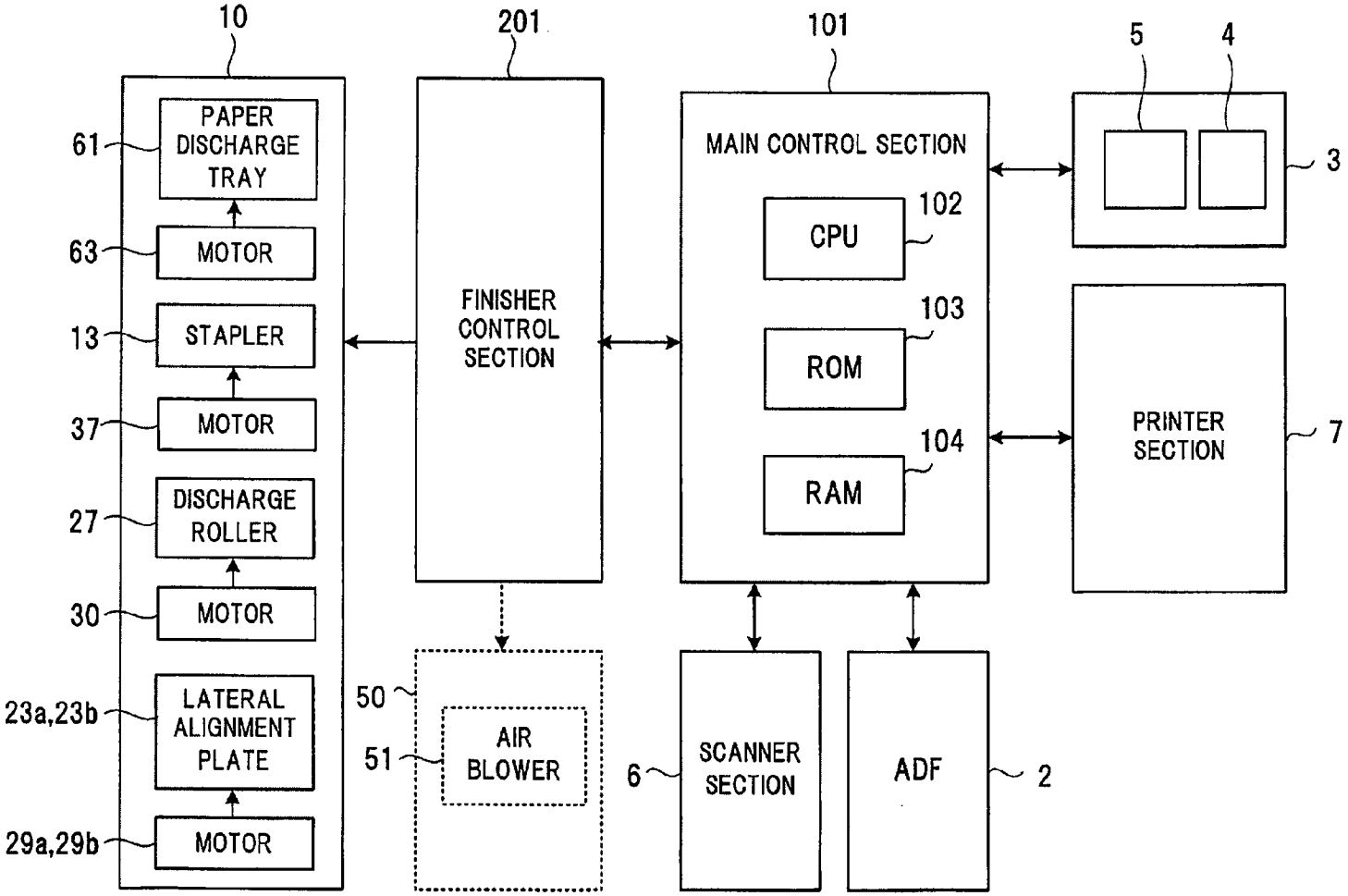
FIG. 14 is a block diagram of control systems of the image forming apparatuses and the finishers in the first and second embodiments.

FIG. 14 is a block diagram of control systems of the image forming apparatus 100 and the finisher 200. In FIG. 14, a main control section 101 includes a CPU 102, a ROM 103, and a RAM 104. The CPU 102 controls the image forming apparatus 100 according to a control program stored in the ROM 103. The main control section 101 controls the operations of the ADF 2, the scanner section 6, and the printer section 7 in response to the operation of the operation panel 3. The RAM 104 is used for temporary storage of control data and arithmetic operation work during the control.

The operation panel 3 includes plural keys 4 and a display section 5 also functioning a touch panel. A user can give various instructions for image formation using the operation panel 3. The user gives an instruction concerning the number of copies using the keys 4 and gives instructions concerning a sheet size, a sheet type, punching, sapling, and the like by operating the touch panel of the display section 5.

A finisher control section 201 controls the operation of the finisher 200 (the staple unit 10) and the operation of sheet discharge. The finisher control section 201 is connected to the main control section 101. The finisher control section 201 performs communication of information with the main control section 101. The image forming apparatus 100 and the finisher 200 operate in association with each other.

The finisher control section 201 controls each of a motor 63 that lifts and lowers the stack tray 61, the motor 37 that controls the position of the stapler 13, the motor 30 that controls the rotation of the discharge rollers 27, and the motors 29*a* and 29*b* that move the lateral alignment plates 23*a* and 23*b*.

According to the second embodiment, the finisher control section 201 controls the rotation of the air blowers 51 of the blower units 50 and controls the air blowers 51 to rotate at timing when the sheets S are discharged from the discharge port 24.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A sheet finishing apparatus comprising:

a processing tray on which a sheet conveyed from an image forming apparatus is stacked;

a finishing section configured to apply a finishing process to the sheet on the processing tray;

a sheet discharging section configured to discharge the sheet subjected to the finishing process to a stack tray via a discharge port;

a roller attached to a shaft provided in parallel to the discharge port and configured to rotate in a first direction for guiding the sheet in a direction of the finishing section and in a second direction for discharging the sheet; and an arm attached to the shaft and extending radially from the shaft, the arm rotating in accordance with a rotation of the shaft in a first direction to a first position where the arm contacts a regulating member provided on the processing tray and not rotating further in the first direction after contacting the regulating member even if the shaft continues to rotate in the first direction, and the arm rotating in accordance with a rotation of the shaft in a second direction to a second position where the arm contacts a trailing portion of a sheet stacked on the stack tray and not rotating further in the second direction after contacting the location even if the shaft continues to rotate in the second direction.

2. The apparatus of claim 1, wherein the arm includes a holding section at an end on the shaft side, the holding section is attached to the shaft, and the holding section is pressed in an end direction of the roller with slip torque applied thereto by a spring.

3. The apparatus of claim 1, wherein the arm is formed in a U shape and includes a pair of holding sections, each disposed at both ends of the U-shaped arm, and the U-shaped arm is attached to the shaft to hold the roller from both sides.

4. The apparatus of claim 1, wherein the finishing section includes a pair of lateral alignment plates configured to that align the sheet in a lateral direction and a stapler configured to staple the sheet aligned by the pair of lateral alignment plates, the pair of lateral alignment plates closing after the arm rotates in the first direction and hits the regulating member if the sheet is guided to the stapler and opening if the sheet is discharged via the discharge port, and the arm rotates in the first direction together with the roller if the sheet is guided to the stapler, and does not rotate further while the lateral alignment plates are closed until the sheet is discharged even if the roller rotates in the second direction after the sheet is stapled, and rotates in the second direction until the arm hits the stack tray after the sheet is discharged and the lateral alignment plates open.

* * * * *